United States Patent [19]

Brischoux et al.

[11] Patent Number: 5,056,809

[45] Date of Patent: Oct. 15, 1991

[54] SAFETY SKI BINDING

[75] Inventors: Jean-Claude Brischoux, Annecy Le Vieux; Gilles Renaud-Goud, Annecy, both of France

[73] Assignee: Salomon S.A., Annecy Cedex, France

[21] Appl. No.: 394,721

[22] Filed: Aug. 16, 1989

[30] Foreign Application Priority Data

Aug. 17, 1988 [FR] France ..... 88 10955

[51] Int. Cl.[5] ..... A63C 9/08

[52] U.S. Cl. ..... 280/617; 280/633

[58] Field of Search ..... 280/633, 634, 636, 618, 280/617, 616, 611; 441/70; 410/104, 105, 150; 269/207, 208, 211, 215, 70

[56] References Cited

U.S. PATENT DOCUMENTS

| | | | |
|---|---|---|---|
| 3,785,666 | 1/1974 | Pierre et al. | 280/633 |
| 3,960,384 | 6/1976 | Salomon | 280/623 |
| 4,157,193 | 6/1979 | Beyl | 280/633 |
| 4,188,044 | 2/1980 | Kautzky | 280/611 |
| 4,522,424 | 7/1985 | Luitz et al. | 280/633 |
| 4,524,990 | 6/1985 | Svoboda et al. | 280/633 |
| 4,681,339 | 7/1987 | Himmetsberger et al. | 280/633 |
| 4,747,613 | 5/1988 | Brichoud | 280/611 |

FOREIGN PATENT DOCUMENTS

| | | | |
|---|---|---|---|
| 0084324 | 7/1983 | European Pat. Off. . | |
| 2617395 | 10/1977 | Fed. Rep. of Germany . | |
| 1464104 | 11/1965 | France . | |
| 2380795 | 2/1978 | France . | |
| 2454822 | 4/1979 | France . | |
| 2614545 | 4/1979 | France . | |
| 469492 | 4/1969 | Switzerland | 280/633 |
| 8907475 | 8/1989 | World Int. Prop. O. | 280/633 |

*Primary Examiner*—David M. Mitchell

*Attorney, Agent, or Firm*—Sandler, Greenblum & Bernstein

[57] ABSTRACT

A safety binding apparatus and a method for positioning the binding upon a ski. The apparatus includes a longitudinal slide affixed to the ski and a body carrying a retention jaw for an end of a boot, an energization mechanism for biasing the jaw, the body being longitudinally slidably mounted on the slide. An assembly is provided for immobilizing the body of the binding on the slide in one or more different longitudinal positions to accommodate the particular shoe or boot to be mounted on the ski. The immobilization assembly includes a plurality of longitudinally aligned notches which respectively define the different longitudinal positions that the body of the binding can occupy on the slide and a latch having at least one projection which is elastically biased toward the notches for engagement of the projection in one of the notches, thus immobilizing the body of the binding on the slide in one of the longitudinal positions. The apparatus further includes at least one removable plug positioned within a respective one of the notches for increasing the ease of assembly and adjustment of the positioning of the body of the binding on the ski, since, according to the method of the invention, the projection of the latch can be simply moved to its selected final predetermined position, sliding over the plug or plugs positioned in the notches which correspond to other, non-selected positions.

36 Claims, 4 Drawing Sheets

SAFETY SKI BINDING

BACKGROUND OF THE INVENTION

1. Field of the Invention

The present invention relates to a safety binding for a ski constituted by two principal portions, namely, a longitudinal slide affixed to the upper surface of the ski and a body which is movably mounted longitudinally on the slide and which can be immobilized on the slide in one of a number of different longitudinal positions.

2. Description of Background and Relevant Information

Various ski bindings are known, both front bindings for securing the front of the shoe or boot and rear bindings for securing the rear of the shoe or boot, which provide for longitudinal adjustment of the body of the binding to adapt the binding to the particular length of the shoe or boot to be mounted on the ski, as well as to adjust the intensity of the force which is exerted against the shoe or boot between the front and rear bindings In such safety bindings a slide is typically provided which is affixed to the ski and which has, over at least a portion of its length, a track constituted by a succession of notches longitudinally spaced from one another which respectively determine the different longitudinal positions that the body of the binding can occupy on the slide.

A latch cooperates with the notches, the latch being movably mounted on the lower portion of the body of the binding which constitutes a base in contact with the slide and which slides thereon. The latch carries at least one projection, or tooth, positioned in a manner so as to be able to be displaced in the longitudinal direction while facing the succession of notches of the track when one slides the body longitudinally on the slide. The latch is elastically fixed to a spring in a manner such that a projection thereof is constantly biased in the direction of the slide, and such that it can be engaged in one of them so as to immobilize the body of the binding in the desired longitudinal position on the slide.

Furthermore, the latch is provided with an element to move it against the biasing action of its return spring when one desires to disengage the projection of the latch from the notch in which it is located so as to adjust the longitudinal position of the body of the binding. Such a safety binding is described, for example, in French Patent Application No. 2,454,822.

The slide of the safety binding can accompany the body of the above-described binding during its manufacture and its assembly and, in this case, the initial operation required for the mounting of the binding on the ski comprises affixing the slide to the ski by means of screws. Alternatively, however, the ski itself can be provided with the slide affixed in position in which case only the body of the binding must be mounted on the slide. In either case, it is necessary to adjust the body of the binding in the appropriate longitudinal position on the slide, which operation requires that, during the sliding movement, the latch must remain raised such that its projection can pass without interference over the notches provided in the slide, which constitutes the adjustment track. Consequently, this requires (1) that the assembler grips, with one of his hands, the body of the binding which is engaged on the slide to make it slide longitudinally and (2) with his other hand, that he lifts the latch with an appropriate tool during the entire sliding movement of the body on the slide. This operation tends to be inconvenient for mounting the binding and, furthermore, the final longitudinal positioning of the body of the binding does not occur automatically.

Another binding of this general type, which is an improvement over the binding disclosed in the aforementioned French application, is disclosed in U.S. Pat. Application Ser. No. 07/185,999, filed on Apr. 25, 1988 and commonly assigned herewith, the disclosure of which is hereby incorporated by reference thereto with respect to the arrangement and operation of the various parts of the disclosed binding, as well as with respect to the discussion of the problems associated with known bindings and the need for solutions therefor.

SUMMARY OF THE INVENTION

The present invention is intended to provide a solution to the problems described above in connection with known bindings by providing a safety binding provided with means making it possible to considerably simplify the assembly and adjustment of the longitudinal positioning of the binding by automatically stopping the body of the binding, as it is slid along the ski, in the longitudinal position corresponding to the position at which the boot is to occupy on the ski.

Accordingly, the present invention includes a longitudinal slide affixed to the ski and a body carrying a retention jaw for an end of a boot, an energization mechanism for biasing the jaw, the body being longitudinally slidably mounted on the slide. An assembly is provided for immobilizing the body of the binding on the slide in one or more different longitudinal positions to accommodate the particular boot to be mounted on the ski. The immobilization assembly includes a plurality of longitudinally aligned notches which respectively define the different longitudinal positions that the body of the binding can occupy on the slide and a latch having at least one projection which is elastically biased toward the notches for engagement of the projection in one of the notches, thus immobilizing the body of the binding on the slide in one of the longitudinal positions. The apparatus further includes at least one removable plug positioned within a respective one of the notches for increasing the ease of assembly and adjustment of the positioning of the body of the binding on the ski, since the projection of the latch can be simply moved to its selected final predetermined position, sliding over the plug or plugs positioned in the notches which correspond to other, nonselected positions.

According to a particular aspect of the invention, each of the plugs completely fills a respective notch within in which it is positioned.

According to an alternative aspect of the invention, each of the plugs only partially fills a respective notch within which it is positioned.

Further according to the invention, each of the plugs has the same or substantially the same width as the respective notches within which the plugs are frictionally maintained.

Still further, each of the notches and each of the plugs has a generally parallelpipedic shape.

Still further, each of the notches has a generally parallelepipedic shape having a predetermined length and a predetermined depth within the slide; each of the notches extend generally transversely lengthwise in the slide; and each of the plugs is a generally parallelepipedic shaped block which has a thickness which is substantially equal to the depth of the notches and less than the length of the notches.

According to a still further aspect of the invention, each of the plugs includes a frontal surface, a lower surface, and a bevelled surface between the frontal surface and the lower surface.

According to a still further aspect of the invention, each of the notches includes a cut-out provided in a portion of the thickness of the slide and an aperture extending further into the thickness of the slide, and each of the plugs further includes a nipple for engagement within the aperture.

According to a still further aspect of the invention, each of the notches includes a bore extending completely through the thickness of the slide.

According to a still further aspect of the invention, the slide has a longitudinal edge, each of the notches includes a vertical cut-out, having a predetermined height and width, formed in the longitudinal edge of the slide, and each of the plugs includes a parallelpipedic block having a height equal to or substantially equal to the height of the cut-outs and a width equal to or substantially equal to the width of the cut-outs.

Still further according to the invention, each of the plugs includes an upper surface and an end surface which engages an end surface of a respective one of the notches, and each of the plugs further includes a bevelled surface extending between the upper surface and the end surface.

According to an alternative embodiment of the invention, the latch includes a flexible blade. The means for elastically biasing the projection toward the notches is constituted by a portion of the flexible blade.

The present invention also includes the method of positioning a ski binding upon a ski, in which said ski binding includes a body which is slidably engaged with a slide, and wherein the body has attached thereto a member which, together with the slide, comprise means for selectively locking the body upon the ski in a predetermined position thereon including a latch mounted on one of the member and the slide and a plurality of notches formed in the other of the member and the slide and a plug positioned within respective ones of the notches, the method comprising the steps of:

(a) removing one of the plugs from the respective notch within which it is positioned;

(b) engaging the member with the slide;

(c) moving the member upon the slide until the latch becomes engaged with the notch from which a respective one of the plugs had been removed.

Further according to the method of the invention, the member is constituted by a base upon which the body of the ski binding is slidably mounted, the ski binding further including means for selectively adjustably positioning the body of the binding upon the base, the method comprising the further step of selectively adjustably positioning the body of the binding upon the base.

The method of the invention further includes the steps of (d) disengaging the latch from the notch; (e) removing another of the plugs from a respective notch; and (f) moving the member upon the slide until the latch becomes engaged with the notch within which the further plug had been positioned.

Further according to the method of the invention, if desired, prior to step (f), a plug can be positioned within the notch from which a plug had been removed in step (a).

BRIEF DESCRIPTION OF THE DRAWINGS

The invention will now be described by way of non-limiting example only, with reference to various embodiments of the present invention in the annexed drawings in which.

DETAILED DESCRIPTION OF PREFERRED EMBODIMENTS

Figure 1:
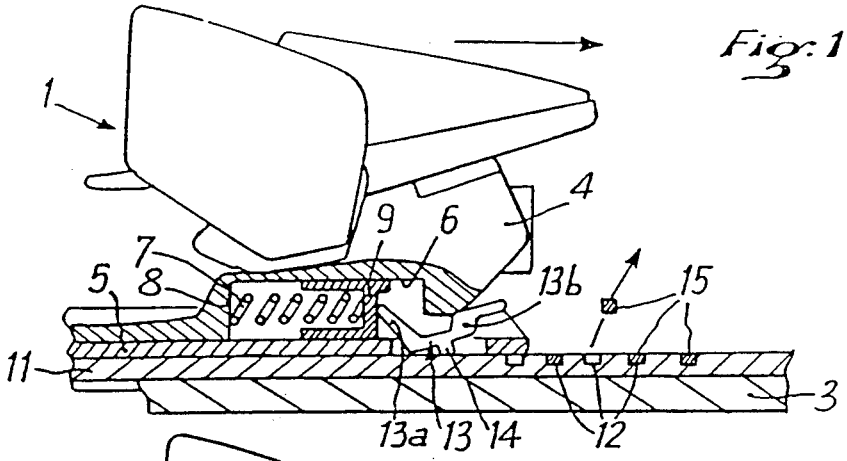
FIG. 1 is an elevational view, partially in vertical and longitudinal cross-section, of a rear binding according to the invention whose body is engaged on the slide affixed to the ski before the final placement of the body of the binding in the desired longitudinal position.

The present invention overcomes the disadvantages described above in connection with known bindings by providing a safety binding provided with means making it possible to considerably simplify the assembly and adjustment of the longitudinal position of the binding by automatically stopping the body of the binding, during the sliding of the body, in the longitudinal position corresponding exactly to the position which the shoe or boot must occupy on the ski, regardless of the length thereof.

To this end, the safety binding of the present invention comprises a longitudinal slide affixed to the ski; a body carrying a retention jaw for one end of a shoe or boot before being mounted on the ski; an energization mechanism of the jaw; the body being longitudinally slidably mounted on the slide; means for immobilizing the body on the slide in one of a plurality of different longitudinal positions, the immobilization means comprising, on one of the two elements which constitute the body and the slide, a succession of longitudinally aligned notches, forming a track, respectively determining the different longitudinal positions that the body can occupy on the slide, and, on the other element, an elastically biased latch comprising, facing the succession of notches, at least one projection, the projection or projections of the latch being elastically biased in the direction of the notches in a manner so as to be able to be engaged in one of the notches and thus immobilize the body on the slide in the desired longitudinal position. The notches of the track, which correspond to binding positions other than the desired position, are blocked by removable plugs.

The safety binding according to the invention, which is shown in particular with regard to FIGS. 1–5, is a heel binding 1 adapted to maintain the rear end of a shoe or boot 2 (FIG. 4) on ski 3. The heel binding 1 comprises a body 4 supporting, at its front portion, a retention jaw for boot 2 and contains an energization mechanism for the jaw. Body 4 is affixed, at its lower portion, to a base 5 on which body 4 can longitudinally slide. In the lower portion of body 4 a longitudinal opening 6 is provided in which a compression spring 7 is located which constitutes a retraction or return spring. This compression spring 7 rests, at its front end, on a transverse surface 8 forming an abutment of body 4, and at its rear end, on a piston 9 slidably mounted within opening 6.

Heel binding 1 furthermore comprises a slide 11 which is affixed to the horizontal upper surface of ski 3 by any appropriate means, for example, by screws. The slide 11 is constituted by a metallic plate which can be initially assembled with base 5 of body 4 of the binding or, alternatively, it can be affixed on the ski before the positioning of body 4 of the binding. In any case, base 5 and slide 11 are configured in a manner so as to be engaged with one another with a minimum of lateral play while nevertheless allowing for the longitudinal sliding of base 5 and, consequently, of body 4 with respect to slide 11 affixed to the ski.

Figure 6:
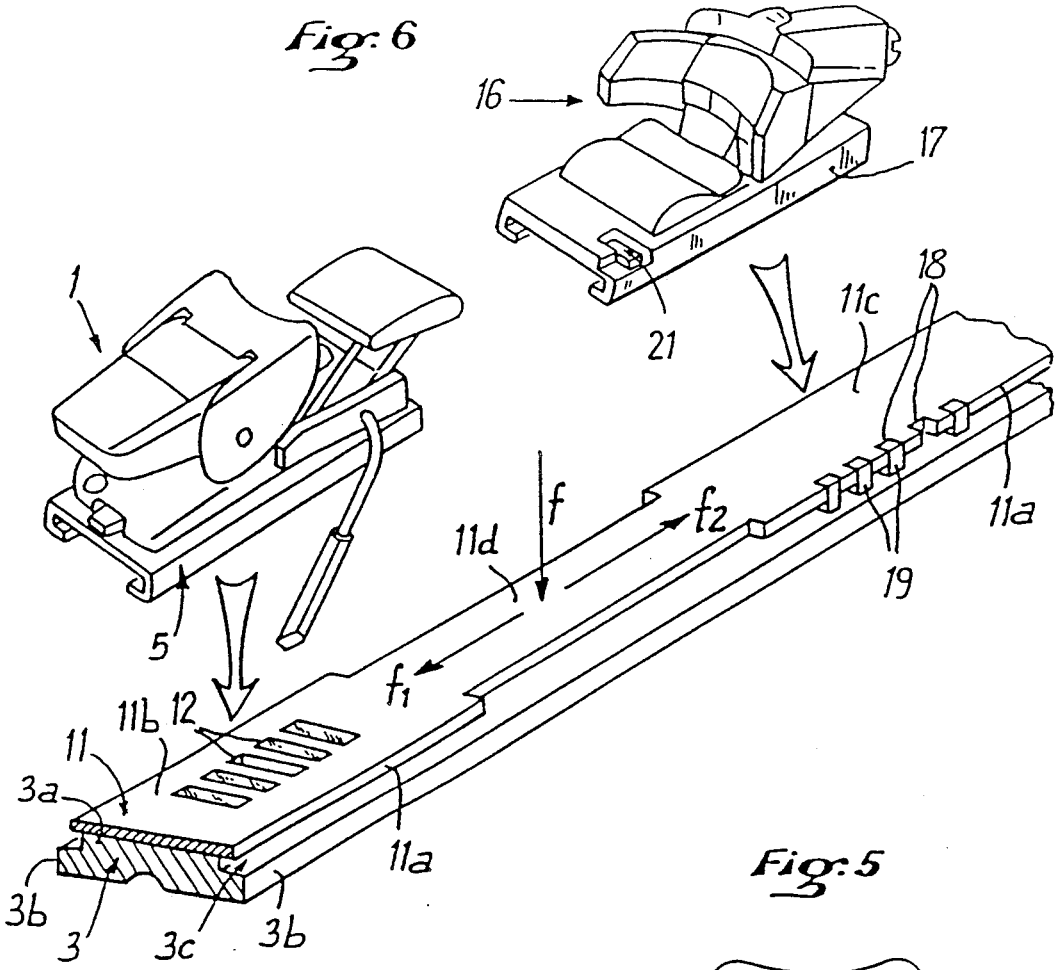
FIG. 6 is perspective view of two safety bindings, namely, a front binding and a rear binding, mounted on a ski by means of a common slide.
Figure 7:
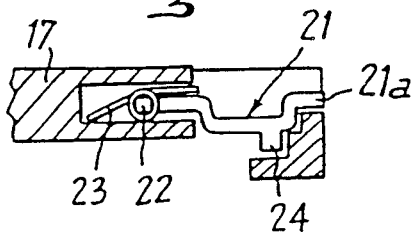
FIG. 7 is a partial vertical and transverse cross-sectional view illustrating the assembly of the latch of the front binding of FIG. 6.
Figure 8:
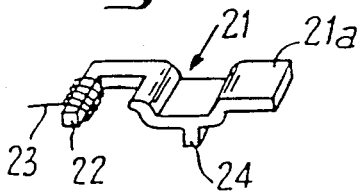
FIG. 8 is a perspective view of the latch of the front binding of FIG. 6.

In the non-limiting embodiment shown in the drawing, the slide 11 constitutes a platform which is affixed to a longitudinal upper projection **3*a* of ski 3, shown in the perspective view of FIG. 6, which has a transverse rectangular cross-section and whose width is thus less than that of ski 3. The platform which forms the slide 11 has itself a width greater than that of the projection 3*a* but less than that of ski 3 so that its two longitudinal edges 11*a* extend slightly beyond and are offset with respect to the two longitudinal edges of projection 3*a*, i.e., they do not extend to the sides 3*b*, 3*c* of ski 3. Furthermore, base 5 which slides on platform 11 forming the slide, has a transverse cross-section in the shape of an inverted C. Otherwise stated, base 5 has a horizontal upper member 5*a* which ends, along its two longitudinal edges, in two short vertical and longitudinal wings 5*b* extending downwardly, themselves extended at their lower ends by two horizontal, or substantially horizontal, short wings 5*c* each extending in the direction of one another, i.e., towards the vertical and longitudinal plane of symmetry of the binding. On each side of base 5 the two wings 5*b* and 5*c* thus constitute a groove which tightly engages a longitudinal edge 11*a* of the platform forming slide 11**.

Figure 3:
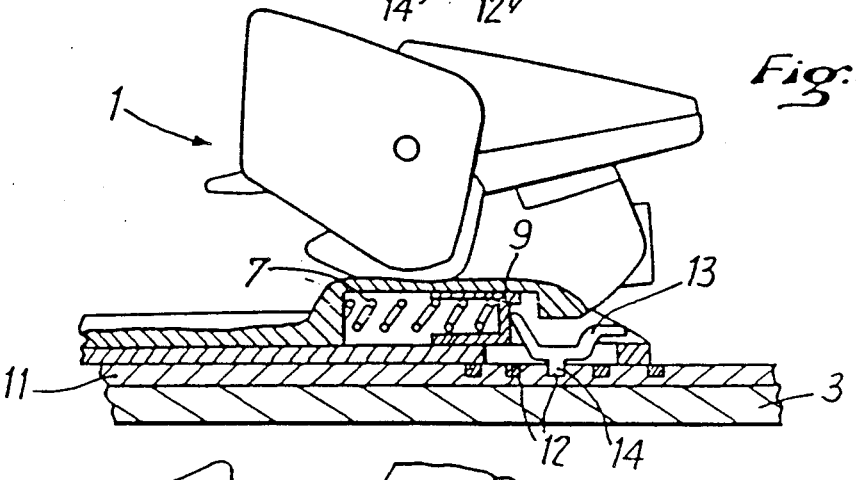
Figure 4:
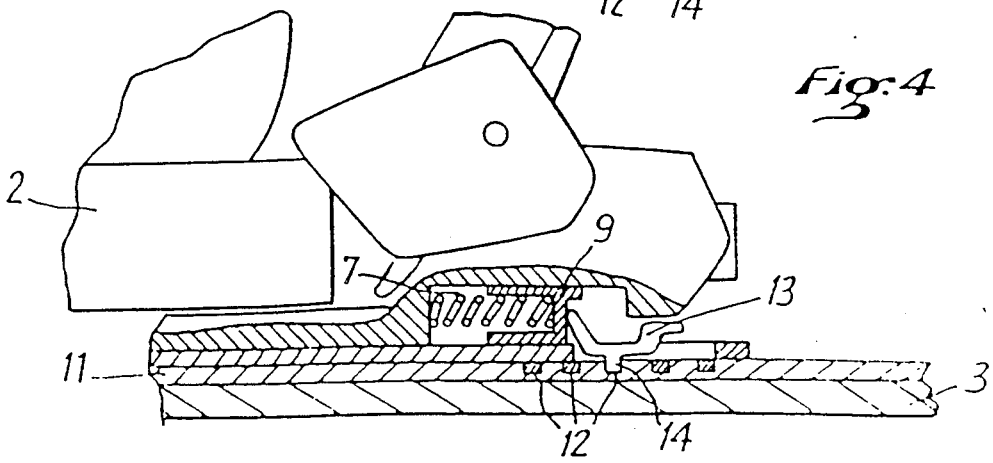
FIG. 4 is a view, similar to that of FIG. 1, of the rear binding after immobilization of a shoe or boot on the ski.
Figure 5:
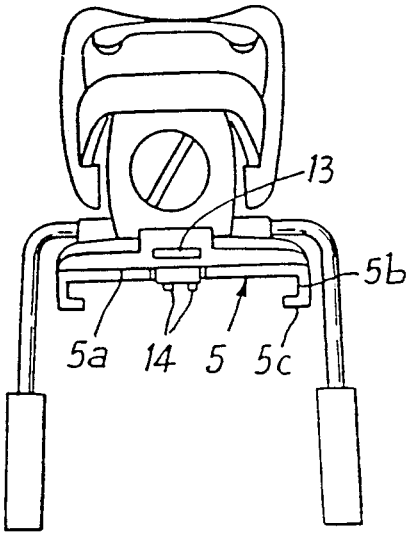
FIG. 5 is a rear view of the rear binding shown in FIGS. 1–4.

For the adjustment of the longitudinal position of the heel binding 1, slide 11 has, at its central portion, a track constituted by a succession of notches 12 which are longitudinally aligned. These notches 12 can be holes, which extend through both sides of slide or cut-outs hollowed in only a portion of the thickness of the slide, as is shown in FIGS. 1–4. The notches 12 can have various shapes and, in particular, they can have, seen in a plan view, a rectangular shape which extend lengthwise in the transverse direction. A latch 13, which is pivotably mounted around a generally transverse axis on base 5 of heel binding, 1 cooperates with notches 12. This latch 13 carries, at its lower surface, at least one projection 14 adapted to engage in notches 12 of slide 11. In the non-limiting embodiment shown in the drawing, the latch 13 carries two teeth or projections 14 which are transversely aligned, as can be seen in FIG. 5. However, in one particular variation, the latch carries at least one succession of a plurality of longitudinally aligned teeth or projections. Latch 13 is elastically biased in a manner such that its one or more lower projections 14 is constantly biased downwardly. In this embodiment, the elastic bias of latch 13 is ensured by the return spring 7 pushing piston 9 towards the rear, which piston is in contact with the end of a front arm **13*a* of latch 13. Latch 13** is thus constantly biased in the clockwise direction in the drawing.

To facilitate the adjustment of the longitudinal position of heel binding 1, slide 11 is delivered, before assembly, with all of its notches 12 effectively blocked by plugs 15. Each of plugs 15 has a shape and dimension such that it effectively entirely blocks the opening of notches 12 and that its upper surface is flush or substantially flush with the upper surface of platform 11 which forms a slide. When the assembler desires to position and immobilize heel binding 1 in the longitudinal position desired, he removes the plug 15 which corresponds to the desired longitudinal position from its respective notch 12. For this purpose, any tool can be used which can be engaged in the notch and "pop" the plug 15 therefrom. In the example shown, the slide 11 is shown to have five successive notches 12, corresponding to five different longitudinal positions. It is likewise shown in FIG. 3 of the example that the heel binding 11 is affixed in the median longitudinal position and, consequently, the assembler first had to remove plug 15 which had been located in the median notch 12, as is illustrated in FIG. 1.

Figure 2:
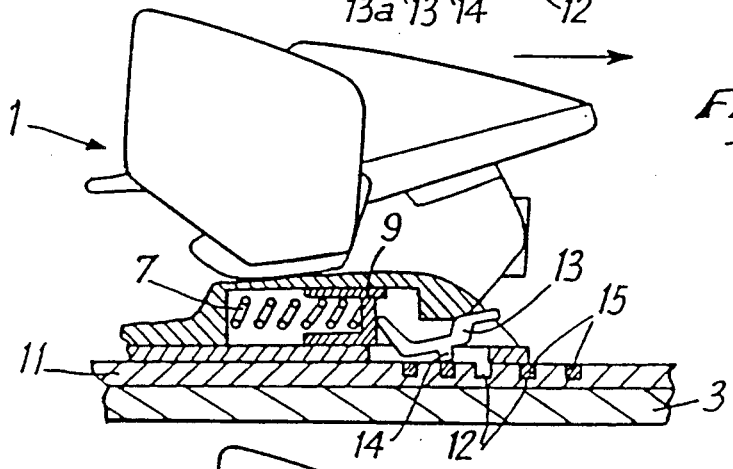
FIGS. 2 and 3 are views, similar to that of FIG. 1, of the heel binding in the course of its longitudinal displacement until its position of desired adjustment.

Once the operation of removing the appropriate plug has been performed, the assembler slides, with a single hand, body 4 of the binding on slide 11, from left to right. In the course of this movement, the latch remains permanently raised because projection 14 of latch 13 slides on the upper surface of slide 11 and it passes without difficulty over the first two notches 12, positioned to the left of the median notch, which are blocked by their respective plugs 15, as is illustrated in FIG. 2. When the body 4 is sufficiently offset towards the right such that the projection 14 of latch 13 is positioned above the median notch 12 from which plug 15 has been ejected, projection 14 of latch 13 can engage in notch 12, as a result of the rocking movement of latch 13 in the clockwise direction, under the effect of return spring 8. As a result of this movement, binding 1 is locked in the desired longitudinal position as is shown in FIG. 3. In this position the latch 13 is thus immobilized and it constitutes, through its lower arm **13*a*, a rear abutment for piston 9. Body 4 of heel binding 1 can, however, slide freely with respect to base 5, during insertion of the shoe or boot 2 as is shown in FIG. 4, the return spring 9** being thus further compressed.

As can be seen in the drawing, latch 13 comprises, at the rear of projection 14, a rear arm **13*b* extending upwardly whose end is accessible from the rear of heel binding 1. It is consequently possible to lift rear arm 13***b* by means of an appropriate tool engaged between the rear arm 13*b* of latch 13 and base 5 and, consequently, to rock the assembly of the latch 13 in the counterclockwise direction, which serves to disengage projection 14 from its notch 12 and to make it possible to again longitudinally slide heel binding 1, to allow for the adjustment of its longitudinal position.

FIG. 6 illustrates two safety bindings mounted on a common slide 11 affixed to ski 3, namely, the heel binding 1 previously described, and a front binding 16. The front binding 16, of any known type, is affixed to base 17, which is similar to base 5 of heel binding 1. Bases 5 and 17 of heel binding and of front binding 16 are respectively slidably engaged on two portions, rear portion 11*b* and front 11*c* of common slide 11, which are connected to one another by a central portion 11*d* of a smaller width. The central portion 11*d* is adapted to allow for engagement of the bindings and 16 first by a movement which is perpendicular, or substantially perpendicular, to the ski (arrow f), then by a longitudinal movement towards the rear for the heel binding 1 (arrow f1) and towards the front for the front abutment 16 (arrow f2). The width of the central portion 11*d* is selected, for this purpose, to be less than the width of the opening defined between the two short horizontal wings constituting the ends of the C-shaped cross-section of the two bases 5 and 17.

The adjustment and longitudinal position of front binding 16 is achieved by means of a succession of notches 18 which are provided in a longitudinal edge 11*a* of the front portion 11*c* of slide 11. These notches are constituted by vertical or substantially vertical cutouts opening onto the edge 11*a* and they are filled by plugs 19 whose upper surfaces are flush or substantially flush with the upper surface of the front portion 11*c*. Latch 21 is pivotal on base 17 of front binding 16 around a longitudinal axis 22 and it is biased downwardly by a spring 23. Latch 21 supports, on its inner surface, a projection 24 which is adapted to become engaged in one of the lateral notches 18. Latch 21 likewise comprises an external arm 21*a* making it possible to lift the latch from the exterior by means of an appropriate tool such as a screwdriver.

As in the case of heel binding 1, the longitudinal position desired for front binding 16 is predetermined by removing a plug 19 from its respective lateral notch 18. In FIG. 6 it has been assumed that the lateral notches 18 are five in number and that the desired longitudinal position corresponding to the engagement of projection 24 of latch 21 in notch 12 is positioned immediately after the frontwardmost notch.

Figure 9:
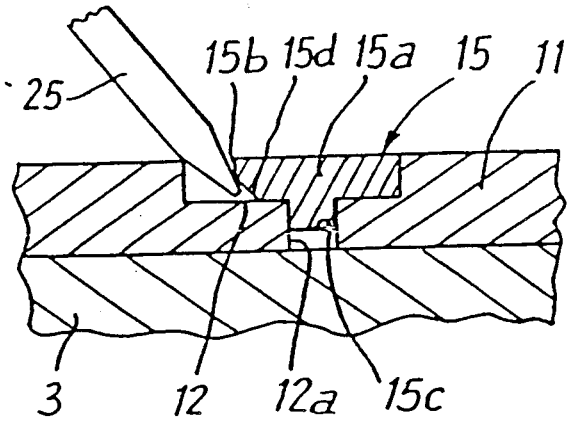
FIG. 9 is a vertical and longitudinal cross-sectional view, on a larger scale, of a portion of the slide comprising a plug engaged in a notch of the slide.
Figure 10:
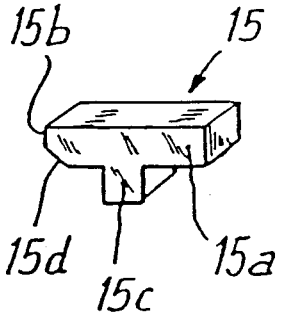
FIG. 10 is a perspective view of the plug shown in FIG. 9.

FIGS. 9 and 10 illustrate, on a larger scale, an embodiment of a plug 15 adapted to be engaged in notches 12 defining the longitudinal positions of heel binding 1, these notches being constituted by parallelpipedic cutouts formed in the upper surface of slide 11. Each plug 15 has a substantially T-shape whose upper head 15*a*, of parallelpipedic shape, has a length which is somewhat less than the length of notch 12, in the transverse direction, in which it is lodged. As a result, a frontal surface 15*b* of this head 15*a* defines, with a frontal surface facing notch 12, a space in which the end of the tool 25, such a screwdriver, can be engaged and which can be utilized as a lever to eject plug 15 from its notch 12. Head 15*a* of plug 15 is extended, at its lower portion, by a nipple 15*c* which engages in a lower corresponding aperture 12*a* extending from notch 12 downwardly, to ensure the maintenance of plug 15 in position. Preferably, to facilitate the disengagement of plug 15 from the notch 12, head 15*a* of plug 15 has between its frontal surface 15*b*, defining the opening for the introduction of tool 25, and its lower surface, a bevelled surface 15*d* which facilitates the penetration of the point of tool 25.

Figure 11:
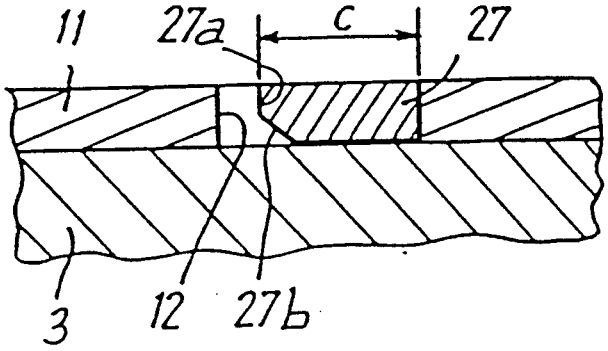
FIG. 11 is a vertical and longitudinal cross-sectional view of on embodiment of a plug engaged in a notch of the slide.
Figure 12:
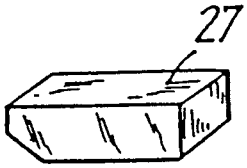
FIG. 12 is a perspective view of the plug shown in FIG. 11.

In the embodiment of the invention shown in FIGS. 11 and 12, the notch 12 is bored on both sides in slide 11 and it defines a parallelpipedic volume. In notch 12 a plug 27 is engaged which has a substantially parallelpipedic shape and a thickness which is equal to or substantially equal to the depth of notch 12 and a width which is equal to or substantially equal to the width of the notch. However, its length is less than the length of notch 12 so as to define, between one of its frontal surfaces 27*a* and the frontal surface facing notch 12, a space in which the end portion of tool 25 can be engaged to "pop" plug 27 out of notch 12. In this embodiment as well, the frontal surface 27*a* preferably has, at its lower portion, a bevelled surface 27*b* which facilitates the penetration of the tip of tool 25.

Figure 13:
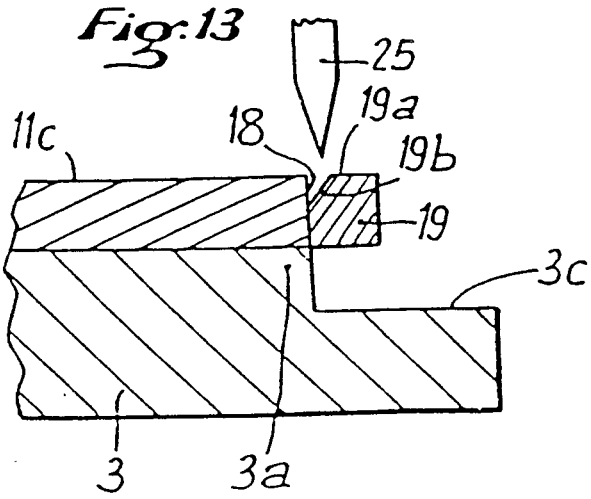
FIG. 13 is a vertical and transverse cross-sectional view, on a larger scale, of a marginal portion of the slide in the longitudinal edge of which are formed the notches containing the plugs.
Figure 14:
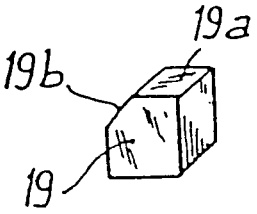
FIG. 14 is a perspective view of a plug shown in FIG. 13.

In the embodiments shown in FIGS. 13 and 14, the plug which is engaged in a lateral notch 18 is constituted by a parallelpipedic block, whose height is equal to or substantially equal to the thickness of slide 11. Furthermore, the width of plug 19 is equal to or substantially equal to that of notch 18 in which it is thus maintained tightly by a friction fit. As with the above-described embodiments, the frontal upper surface 19*a* of plug 19, which is flush or substantially flush with the upper surface of the portion 11*c* of slide 11, preferably has a bevelled surface 19*b* at the location where it is in contact with the bottom of the lateral notch 18, so as to allow for the introduction of the tip of a tool 25 utilized for the ejection of plug 19.

Although in the description which has preceded it has been indicated that notches 12 and 18 and the corresponding plugs 15, 19, 27 preferably have a parallelpipedic shape, this shape is not limiting and other shapes can be utilized such as, e.g., prismatic or cylindrical shapes, in particular.

Figure 16:
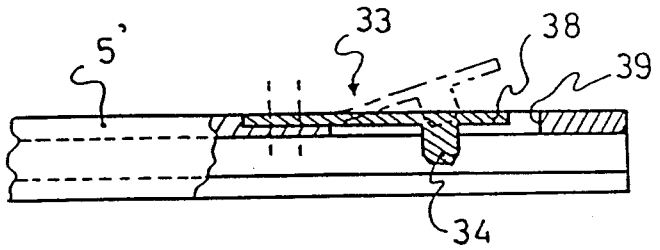
FIGS. 15 and 16 illustrate one alternative embodiment of the invention.
Figure 15:
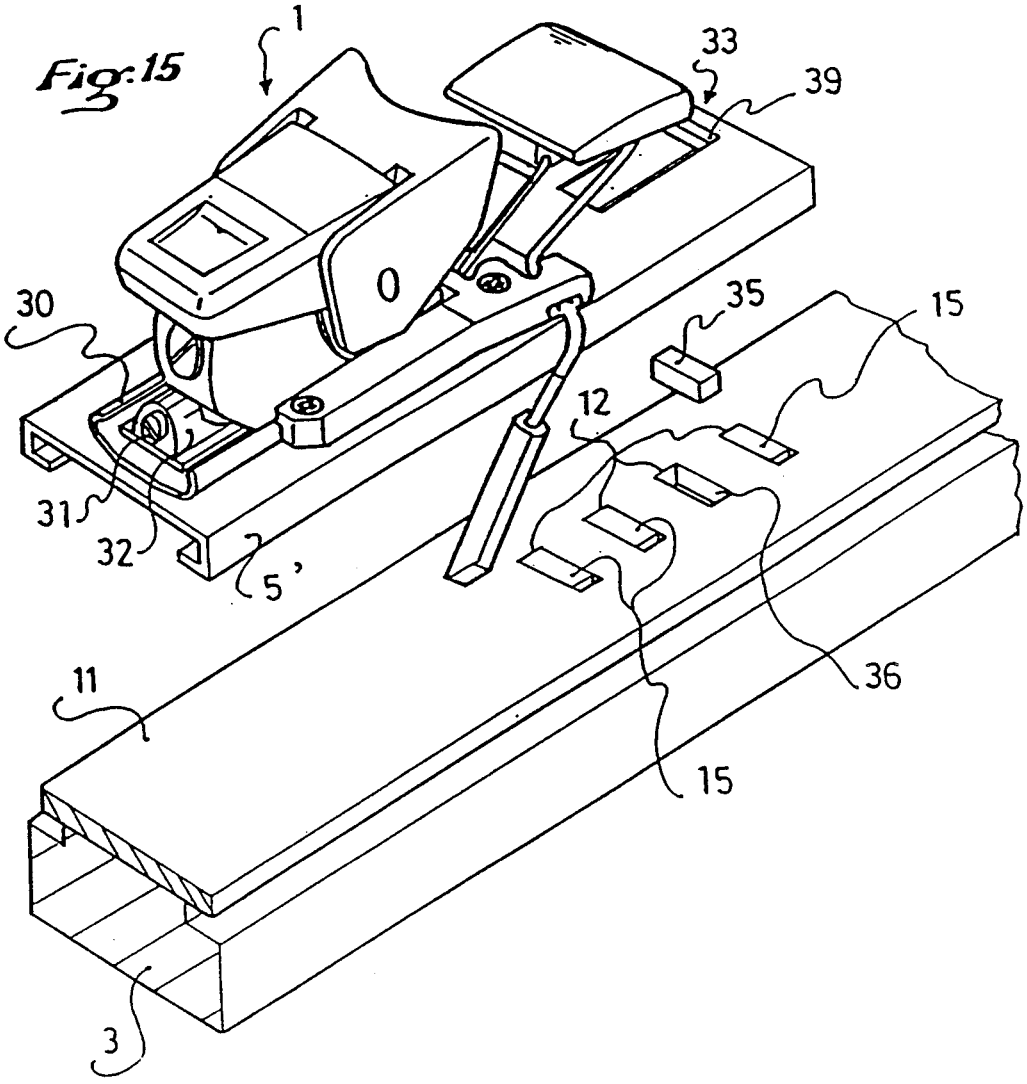

FIGS. 15 and 16 illustrate another embodiment according to which the method of adjustment by plugs previously described is combined with a conventional length adjustment.

Binding 1 is mounted on base 5' by means of a slide 30, the binding 1 being slidable in a longitudinal direction along the length of this slide. Slide 30 is affixed integrally with base 5'.

The longitudinal displacement of binding 1 along slide 30 is controlled by means which make it possible to adjust the initial position of the binding on its slide. These means are illustrated as a micrometric screw 31, whose head is retained by an upstanding lug 32 affixed to the slide, and whose threaded portion is engaged in a tapped orifice (not visible) of the body of binding 1. This construction is known of one of ordinary skill in the art.

These means are not limiting and, for example, one of ordinary skill in the art can utilize a toothed latch whose teeth engage in one of the notches of a series of notches carried by slide 30. Further, starting from the initial position defined by the length adjustment means, during skiing, one can displace the binding along the slide towards the rear against the return force of the springs.

Base 5' itself is similar to base 5 described in connection to FIG. 6, and it cooperates with slide 11 of ski 3.

As in the preceding case, slide 11 has a series of notches 12 which are blocked by plugs 15. FIG. 15 shows a plug 35 which has been removed from its notch 36. In the embodiment shown, base 5' has, in its front portion, a latch 33 which carries a tooth 34 which is adapted to engage in the notch whose plug has been removed, i.e., the notch 36.

The latch 33 is, for example, constituted by a flexible blade 38 which is mounted within a longitudinal slot 39 of base 5', flush or substantially flush with the upper surface base 5'. Blade 38 is connected to the base preferably at its rear portion. Furthermore, it is elastically prestressed in a manner such that tooth 34 projects toward the lower surface of the base, as is seen in FIG. 16.

The assembly of binding 1 on ski 3 occurs in the following manner. Depending upon the size of the boot of the skier, the assembler determines which plug 15 must be removed (for example, plug 35), and he removes it in a manner previously described. He engages base 5' on slide 11 and slides the binding until tooth 34 of latch 33 falls in the unblocked notch 33. This constitutes a "rough" positioning of the binding. A more precise adjustment of the longitudinal position is achieved by turning the screw 31. Thus, notches 15 make it possible to achieve a rough adjustment, for example, for different size ranges of shoes or boots, fine adjustment then being achieved by other length adjustment means which are particular to the binding.

In the case in which the binding must be subsequently displaced on the ski by a substantial amount, the assembler disengages latch 33 from notch 36 and then extracts the plug 12 corresponding to the new longitudinal position desired. If desired, he "re-blocks" the first notch 36 by means of a plug 12.

Finally, although the invention has been described with reference to particular means, materials, and embodiments, it is to be understood that the invention is not limited to the particulars disclosed and extends to all equivalents within the scope of the claims.

What is claimed is:

1. A safety binding apparatus for a ski comprising:

(a) a longitudinal slide affixed to the ski;

(b) a body, including means for longitudinally slidably mounting said body on said slide;

(c) a retention jaw carried by said body for engagement with an end of a boot;

(d) an energization mechanism for biasing said jaw;

(e) means for immobilizing said body on said slide in one or more different longitudinal positions;

said means for immobilizing comprising, on one of said body and said slide;

(i) a plurality of longitudinally spaced notches respectively defining said different longitudinal positions that said body can occupy on said slide; and (ii) a plurality of removable plugs positioned within all of said plurality of longitudinally spaced notches; and said means for immobilizing comprising, on the other of said body and said slide:

(iii) a latch having at least one projection; and (iv) means for elastically biasing said projection in a direction toward and against said slide for selective engagement of said projection in one of said notches, in response to a plug having been removed from said one of said notches, and in response to movement of said projection to a position in alignment with and engagement in said one of said notches, and thus immobilizing said body on said slide in one of said longitudinal positions.

2. A safety binding apparatus for a ski according to claim 1, wherein each of said plugs completely fills a respective notch within in which it is positioned.

3. A safety binding apparatus for a ski according to claim 1, wherein each of said plugs only partially fills a respective notch within which it is positioned.

4. A safety binding apparatus for a ski according to claim 1, wherein each of said plugs has the same or substantially the same width as the respective notches within which said plugs are frictionally maintained.

5. A safety binding apparatus for a ski according to claim 1, wherein each of said notches and each of said plugs has a generally parallelpipedic shape.

6. A safety binding apparatus for a ski according to claim 1, wherein each of said notches has a generally parallelepipedic shape having a predetermined length and a predetermined depth within said slide, wherein said length of each of said notches extends generally transversely with respect to said slide, and wherein each of said plugs comprises generally parallelepipedic shaped blocks which have a thickness which is substantially equal to said depth of said notches and a length which is less than said length of said notches.

7. A safety binding apparatus for a ski according to claim 6, wherein each of said plugs further comprises a frontal surface, a lower surface, and a bevelled surface between said frontal surface and said lower surface.

8. A safety binding apparatus for a ski according to claim 1, wherein each of said notches comprises a cut-out provided in a portion of the thickness of said slide and an aperture extending further into said thickness of said slide, wherein each of said plugs further comprises a nipple for engagement within said aperture.

9. A safety binding apparatus for a ski according to claim 6, wherein each of said notches further comprises a bore extending completely through the thickness of said slide.

10. A safety binding apparatus for a ski according to claim 7, wherein each of said notches further comprises a bore extending completely through the thickness of said slide.

11. A safety binding apparatus for a ski according to any one of claims 1–5, wherein said slide has a longitudinal edge, wherein each of said notches comprise a vertical cut-out, having a predetermined height and width, formed in said longitudinal edge of said slide, and wherein each of said plugs comprises a parallelpipedic block having a height equal to or substantially equal to said height of said cut-outs and a width equal to or substantially equal to said width of said cut-outs.

12. A safety binding apparatus for a ski according to claim 11, wherein each of said plugs further comprises an upper surface and an end surface which engages an end surface of a respective one of said notches, wherein each of said plugs further comprises a bevelled surface extending between said upper surface and said end surface.

13. A safety binding apparatus for a ski according to claim 1, wherein said latch comprises a flexible blade.

14. A safety binding apparatus for a ski according to claim 13, wherein said means for elastically biasing said projection toward said notches is constituted by a portion of said flexible blade.

15. A safety binding apparatus for a ski according to claim 1, wherein said longitudinally spaced notches are longitudinally aligned.

16. A safety binding apparatus for a ski according to claim 1, wherein said immobilization means comprises a single stable position in which said latch is biased against said slide by means of said means for elastically biasing means.

17. A safety binding apparatus for a ski according to claim 1, further comprising an additional plurality of longitudinally spaced notches, laterally spaced with respect to the first-mentioned plurality of longitudinally spaced notches, wherein said latch comprises a plurality of laterally spaced projections, wherein said means for elastically biasing said projection comprises means for elastically biasing said plurality of projections in a direction toward and against said slide for selective engagement in a respective plurality of said laterally spaced notches, in response to a plug having been removed from said respective plurality of laterally spaced notches and in response to movement of said plurality of spaced projections to a position in alignment with and engagement in said respective plurality of laterally spaced notches, and thus immobilizing said body on said slide in one of said longitudinal positions.

18. A longitudinal slide apparatus adapted to be affixed to a ski and adapted to longitudinally slidably support a binding on said slide, said slide comprising a plurality of longitudinally spaced notches which are adapted to be engaged by a latch on said binding for respectively defining different longitudinal positions that said binding can occupy on said slide, said slide apparatus further comprising a plurality of removable plugs positioned within respective longitudinally successive ones of said plurality of notches, wherein said slide has a longitudinal edge, wherein each of said notches comprises a vertical cut-out, having a predetermined height and width, formed in said longitudinal edge of said slide, and wherein said each of said plugs comprises a parallelepipedic block having a height equal to or substantially equal to said height of said cut-outs and a width equal to or substantially equal to said width of said cut-outs.

19. A longitudinal slide apparatus according to claim 18, wherein each of said plugs completely fills a respective notch within in which it is positioned.

20. A longitudinal slide apparatus according to claim 12, wherein each of said plugs only partially fills a respective notch within which it is positioned.

21. A longitudinal slide apparatus according to claim 18, wherein each of said plugs has the same or substantially the same width as the respective notches within which said plugs are frictionally maintained.

22. A longitudinal slide apparatus according to claim 18, wherein each of said notches and each of said plugs has a generally parallelpipedic shape.

23. A longitudinal slide apparatus according to claim 18, wherein each of said notches has a generally parallelepipedic shape having a predetermined length and a predetermined depth within said slide, wherein said length of each of said notches extends generally transversely with respect to said slide, and wherein each of said plugs comprises generally parallelepipedic shaped blocks which has a thickness which is substantially equal to said depth of said notches and a length which is less than said length of said notches.

24. A longitudinal slide apparatus according to claim 23, wherein each of said plugs further comprises a frontal surface, a lower surface, and a bevelled surface between said frontal surface and said lower surface.

25. A longitudinal slide apparatus according to claim 18, wherein each of said notches comprises a cut-out provided in a portion of the thickness of said slide and an aperture extending further into said thickness of said slide, wherein each of said plugs further comprises a nipple for engagement within said aperture.

26. A longitudinal slide according to claim 2, wherein each of said notches further comprises a bore extending completely through the thickness of said slide.

27. A longitudinal slide apparatus according to claim 24, wherein each of said notches further comprises a bore extending completely through the thickness of said slide.

28. A longitudinal slide apparatus according to claim 18, wherein each of said plugs further comprises an upper surface and an end surface which engages an end surface of a respective one of said notches, wherein each of said plugs further comprises a bevelled surface extending between said upper surface and said end surface.

29. A longitudinal slide apparatus according to claim 18, wherein said longitudinally spaced notches are longitudinally aligned.

30. A method of positioning a ski binding upon a ski, in which said ski binding comprises a body which is slidably engaged with a slide, and wherein said body has attached thereto a member which, together with said slide, comprise means for selectively locking said body upon said ski in a predetermined position thereon including a latch mounted on one of said member and said slide and a plurality of notches formed in the other of said member and said slide and a respective plug positioned within each of respective ones of said notches, said latch being engagable within any of said notches after removal of a plug from said notches, said method comprising the steps of:

(a) removing one of said plugs from a notch within which said one of said plugs is positioned;
(b) engaging said member and latch with said slide;
(c) moving said member upon said slide, with said latch contacting said slide, until said latch becomes engaged with said notch from which said one of said plugs had been removed.

31. A method of positioning a ski binding upon a ski according to claim 30, wherein said member comprises a base upon which said body of said ski binding is slidably mounted, wherein said ski binding further comprises means for selectively adjustably positioning said body of said binding upon said base, and wherein said method comprises the further step of selectively adjustably positioning said body of said binding upon said base.

32. A method of positioning a ski binding upon a ski according to claim 30, comprising the further steps of (d) disengaging said latch from said notch; (e) removing another of said plugs from a respective notch; and (f) moving said member upon said slide until said latch becomes engaged with said notch within which said another of said plugs had been positioned.

33. A method of positioning a ski binding upon a ski according to claim 32, wherein prior to step (f), a plug is positioned within said notch from which a plug had been removed in step (a).

34. A safety binding apparatus for a ski comprising:

(a) a longitudinal slide affixed to the ski;

(b) a body, including means for longitudinally slidably mounting said body on said slide;

(c) a retention jaw carried by said body for engagement with an end of a boot;

(d) an energization mechanism for biasing said jaw;

(e) means for immobilizing said body on said slide in one or more different longitudinal positions;

said means for immobilizing comprising, on one of said body and said slide:

(i) a plurality of longitudinally spaced notches, a respective number of said notches defining said different longitudinal positions that said body can occupy on said slide; and (ii) a plurality of removable plugs positioned within all of said notches; and said means for immobilizing comprising, on the other of said body and said slide:

(iii) a latch having at least one projection, said at least one projection being equal in number to said respective number of notches defining said different longitudinal positions; and (iv) means for elastically biasing said at least one projection in a direction toward and against said slide for selective engagement of said at least one projection in said respective number of notches, in response to a plug having been removed from said respective number of notches, and in response to movement of said at least one projection to a position in alignment with an engagement in said respective number of notches, and thus immobilizing said body on said slide in one of said longitudinal positions.

35. A safety binding apparatus for a ski according to claim 34, wherein said at least one projection comprises only one projection and wherein said respective number of notches comprises one.

36. A safety binding apparatus for a ski according to claim 35, wherein said at least one projection comprises two projections and wherein said respective number of notches comprises two.

* * * * *